US008190073B2

(12) United States Patent
Watanabe et al.

(10) Patent No.: US 8,190,073 B2
(45) Date of Patent: May 29, 2012

(54) ENDLESS BELT, BELT CONVEYOR AND IMAGE FORMING APPARATUS

(75) Inventors: Takeshi Watanabe, Osaka (JP); Akira Matayoshi, Osaka (JP)

(73) Assignee: Kyocera Mita Corporation (JP)

( * ) Notice: Subject to any disclaimer, the term of this patent is extended or adjusted under 35 U.S.C. 154(b) by 1006 days.

(21) Appl. No.: 12/134,313

(22) Filed: Jun. 6, 2008

(65) Prior Publication Data

US 2008/0304881 A1 Dec. 11, 2008

(30) Foreign Application Priority Data

Jun. 11, 2007 (JP) ..... 2007-154198

(51) Int. Cl.
*G03G 15/20* (2006.01)

(52) U.S. Cl. ..... 399/308; 399/165

(58) Field of Classification Search ..... 399/162, 399/165, 302, 303, 308, 312, 329; 430/125.32; 198/844.2, 845, 847
See application file for complete search history.

(56) References Cited

U.S. PATENT DOCUMENTS 5,455,136 A * 10/1995 Yu et al. ..... 430/58.65
6,674,989 B1 * 1/2004 Kusaba et al. ..... 399/302
7,819,240 B2 * 10/2010 Kim ..... 198/809
2005/0123326 A1 * 6/2005 Ito et al. ..... 399/313
2006/0172097 A1 * 8/2006 Morikoshi et al. ..... 428/35.7

FOREIGN PATENT DOCUMENTS

JP 01178436 A * 7/1989
JP 11-59962 3/1999
JP 2002268508 A * 9/2002
JP 2003131458 A * 5/2003
JP 2005234445 A * 9/2005
JP 2007139997 A * 6/2007

* cited by examiner

*Primary Examiner* — Robert Beatty

(74) *Attorney, Agent, or Firm* — Gerald E. Hespos; Michael J. Porco

(57) ABSTRACT

An endless belt is provided with an endless belt body and a meandering prevention member in the form of a flat bar. The belt body includes a folded trace extending in the width direction thereof. The meandering prevention member is attached on one widthwise end of a circumferential surface of the belt body such that one widthwise end of the folded trace is covered thereby and the opposite longitudinal ends of the meandering prevention member abut each other in a rotating direction of the belt body. An abutting portion at the opposite ends of the meandering prevention member is arranged at a position displaced from the folded trace by a specified distance in the rotating direction of the belt body.

12 Claims, 5 Drawing Sheets

ENDLESS BELT, BELT CONVEYOR AND IMAGE FORMING APPARATUS

BACKGROUND OF THE INVENTION

1. Field of the Invention

The present invention relates to an endless belt, a belt conveyor provided with the belt and an image forming apparatus provided with the belt and particularly to an endless belt comprising an endless belt body formed by inflation molding, a belt conveyor provided with the belt and an image forming apparatus provided with the belt.

2. Description of the Related Art

A known image forming apparatus such as a printer transfers toner images on photoconductive drums to an intermediate transfer belt (primary transfer), subsequently transfers toner images on the intermediate transfer belt (belt) to a sheet in a nip portion between the intermediate transfer belt and a secondary transfer roller at once (secondary transfer), and then forms an image on the sheet (see, for example, Japanese Unexamined Patent Publication No. H11-59962).

The above intermediate transfer belt is generally endless and formed by inflation molding. FIG. 5 is a schematic diagram of an extruder showing a method for forming an intermediate transfer belt by inflation molding using the extruder. In this forming method, as shown in FIG. 5, a raw material 2 poured into the extruder 1 is cooled by cooling air 4 while being extruded through a die 3 of the extruder 1. In this way, a tubular body 5*a* solidified to a certain extent as shown in FIG. 6 is formed. Subsequently, the tubular body 5*a* is squeezed flat as shown in FIG. 7 by a pair of pinch rollers 6 at the top of the extruder 1, and the both longitudinal sides of the tubular body 5*a* are folded. Then, a squeezed tubular body 5*b* is concentrically taken up. An intermediate transfer belt is obtained by cutting the above taken-up tubular body 5*b* to a specified length in a take-up direction. This specified length is the width of the intermediate transfer belt.

The intermediate transfer belt formed by inflation molding in this way has folds at two positions in a rotating direction of the intermediate transfer belt corresponding to the opposite ends of the flat tubular body 5*b*. These folds become folded traces which is finally unnoticeable in appearance after a heating process and the like.

However, the above folded traces are thinner than the other portions of the intermediate transfer belt when they are formed and, accordingly, have lower strength. Thus, upon driving the extended intermediate transfer belt, cracks are likely to occur at one of the opposite ends of the folded traces of the intermediate transfer belt due to various loads such as tensile stresses and bending stresses acting on the intermediate transfer belt. Therefore, there has been a demand for improving the durability of the intermediate transfer belt.

SUMMARY OF THE INVENTION

An object of the present invention is to provide an endless belt having good durability, a belt conveyor provided with the belt and an image forming apparatus provided with the belt.

One aspect of the present invention is directed to an endless belt, comprising: an endless belt body; and a first meandering prevention member which is a member in the form of a flat bar and adapted to prevent meandering of the belt body, wherein: the belt body includes a folded trace extending in the width direction thereof; the first meandering prevention member is attached on one widthwise end of a circumferential surface of the belt body such that one widthwise end of the folded trace is covered thereby and the opposite longitudinal ends of the first meandering prevention member abut each other in a rotating direction of the belt body; and an abutting portion at the opposite ends of the first meandering prevention member is arranged at a position displaced from the folded trace by a specified distance in the rotating direction of the belt body.

Another aspect of the present invention is directed to a belt conveyor, comprising a first roller; a second roller; and an endless belt mounted on the first and second rollers, wherein the endless belt is the above endless belt.

Still another aspect of the present invention is directed to an image forming apparatus, comprising a photoconductive drum capable of bearing a toner image; an endless intermediate transfer belt held in contact with the photoconductive drum and mounted on a plurality of rollers; a primary transfer roller for transferring a toner image formed on the photoconductive drum to the intermediate transfer belt; and a secondary transfer roller for transferring the toner image on the intermediate transfer belt to a sheet, wherein the intermediate transfer belt is the above endless belt.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, one embodiment of the present invention is described in detail with reference to the accompanying drawings.

Figure 1:
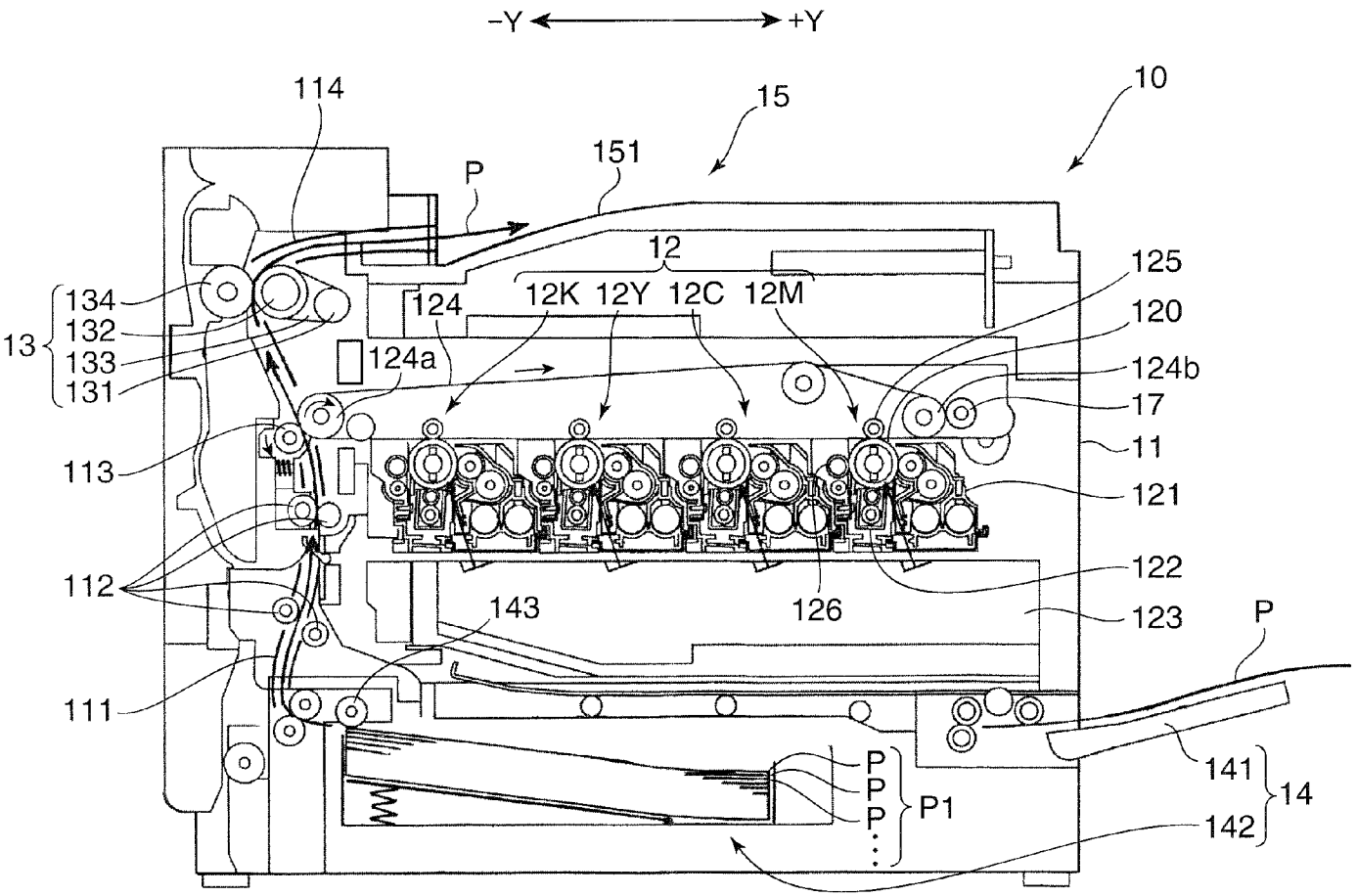
FIG. 1 is a section showing the entire construction of a printer according to one embodiment of the invention.

FIG. 1 is a section showing the entire construction of a printer according to one embodiment of the present invention. First of all, an overview of the internal construction of the printer (image forming apparatus) 10 according to the present invention is described. It should be noted that Y-Y directions in FIG. 1 are referred to as forward and backward directions, particularly −Y direction as forward direction and +Y direction as backward direction.

As shown in FIG. 1, the printer 10 of this embodiment is constructed such that an image forming assembly 12 for forming an image based on image information transmitted from an external apparatus such as computer, a fixing unit 13 for applying a fixing process to an image formed and transferred to a sheet P by the image forming assembly 12 and a sheet storing unit 14 for transfer sheets are installed in a box-shaped apparatus main body 11. A sheet discharge unit 15, to which the sheet P after the fixing process is discharged, is formed atop the apparatus main body 11.

In the image forming assembly 12, a toner image is formed on a sheet P fed from the sheet storing unit 14. In the image forming assembly 12, a magenta unit 12M using a magenta developer, a cyan unit 12C using a cyan developer, a yellow unit 12Y using a yellow developer and a black unit 12K using a black developer are successively arranged from an upstream side (rear side in FIG. 1) toward a downstream side.

Each of the units 12M, 12C, 12Y and 12K includes a photoconductive drum 120 and a developing device 121. The photoconductive drum 120 is a part for forming an electrostatic latent image and a toner image (visible image) in conformity with the electrostatic latent image on the outer circumferential surface thereof. An amorphous silicon layer, which is tough, excellent in abrasion resistance and very smooth, is formed on the outer circumferential surface of the photoconductive drum 120. Thus, the photoconductive drum 120 is suitable for forming an electrostatic latent image and a toner image. Each photoconductive drum 120 receives the supply of the developer from the corresponding developing device 121 while being rotated in a counterclockwise direction in FIG. 1.

A charger 122 is disposed at a position right below each photoconductive drum 120, and an exposing device 123 is disposed below each charger 122. Each photoconductive drum 120 has the outer circumferential surface thereof uniformly charged by the charger 122, and the charged outer circumferential surface of the photoconductive drum 120 is irradiated with a laser beam of the corresponding color from the exposing device 123, the laser beam being based on image data inputted from a computer or the like. In this way, an electrostatic latent image is formed on the outer circumferential surface of the photoconductive drum 120. The developer is supplied from the developing device 121 to such an electrostatic latent image, whereby a toner image is formed on the outer circumferential surface of the photoconductive drum 120.

A belt conveyor is arranged at a position above the respective photoconductive drums 120. The belt conveyor includes a drive roller 124*a*, a driven roller 124*b* and an intermediate transfer belt 124, wherein the intermediate transfer belt 124 is so mounted between the drive roller 124*a* and the driven roller 124*b* as to touch the respective photoconductive drums 120. The intermediate transfer belt 124 mounted on the drive roller 124*a* and the driven roller 124*b* turns between the drive roller 124*a* and the driven roller 124*b* in synchronism with the respective photoconductive drums 120 while being pressed against the outer circumferential surfaces of the photoconductive drums 120 by primary transfer rollers 125 disposed in correspondence with the respective photoconductive drums 120.

A toner image of the magenta toner by the photoconductive drum 120 of the magenta unit 12M is first transferred to the outer circumferential surface of the intermediate transfer belt 124. Subsequently, a toner image of the cyan toner by the photoconductive drum 120 of the cyan unit 12C is transferred to be superimposed at the same position of the intermediate transfer belt 124. Then, a toner image of the yellow toner by the photoconductive drum 120 of the yellow unit 12Y is transferred to be superimposed at the same position of the intermediate transfer belt 124. Finally, a toner image of the black toner by the photoconductive drum 120 of the black unit 12K is transferred to be superimposed. Thus, a color toner image is formed on the outer circumferential surface of the intermediate transfer belt 124 during a turning movement of the intermediate transfer belt 124. This color toner image formed on the outer circumferential surface of the intermediate transfer belt 124 is transferred to a sheet P conveyed from the sheet storing unit 14.

Then, the residual toners on the outer circumferential surfaces of the photoconductive drums 120 are removed by cleaning devices 126 disposed before the respective photoconductive drums 120 in FIG. 1. The outer circumferential surfaces of the photoconductive drums 120 cleaned by the cleaning devices 126 head for the chargers 122 for next charging processes.

A vertically extending sheet conveyance path 111 is formed at a front position of the image forming assembly 12 in FIG. 1. This sheet conveyance path 111 includes pairs of conveyor rollers 112 at suitable positions, and a sheet from the sheet storing unit 14 is conveyed toward the intermediate transfer belt 124 mounted on the drive roller 124*a* by driving the pairs of conveyor rollers 112. On such a sheet conveyance path 111, a secondary transfer roller 113 held in contact with the outer circumferential surface of the intermediate transfer belt 124 is disposed at a position facing the drive roller 124*a*. The sheet P passes a nip portion between the intermediate transfer belt 124 and the secondary transfer roller 113 to be pressed between the intermediate transfer belt 124 and the secondary transfer roller 113, whereby the toner image on the intermediate transfer belt 124 is transferred to the sheet P.

The fixing device 13 includes a heating roller 131 having an electrical heating element as a heating source inside, a fixing roller 132 arranged to face the heating roller 131 at front in FIG. 1, a fixing belt 133 mounted between the fixing roller 132 and the heating roller 131 and a pressure roller 134 arranged to face the fixing roller 132 via the fixing belt 133. The fixing device 13 applies a fixing process to the toner image transferred to the sheet in the image forming assembly 12.

Specifically, with the toner image on the intermediate transfer belt 124 transferred to the sheet P by the passage of the sheet P through the nip portion between the intermediate transfer belt 124 and the secondary transfer roller 113, the sheet P is fed to the fixing unit 13 and receives heat from the fixing belt 133 while passing between the pressure roller 134 and the fixing belt 133 having a high temperature. In this way, the fixing process is applied.

The sheet P having the color image completely fixed thereto is discharged to a discharge tray 151 of the sheet discharge unit 15 provided atop the apparatus main body 11 through a discharge path 114 extending from the top of the fixing unit 13.

The sheet storing unit 14 includes a manual feed tray 141 openably and closably provided on the rear wall of the apparatus main body 11 in FIG. 1 and a sheet tray 142 detachably mounted at a position below the exposure devices 123. A stack of sheets can be stored in the sheet tray 142.

The sheet tray 142 has a container body whose upper surface is entirely open, and a sheet stack P1, in which a plurality of sheets P are stacked, can be stored therein. The uppermost one P of the sheet stack P1 stored in such a sheet tray 142 is fed from the sheet stack P1 toward the sheet conveyance path 111 by having the upper surface of the downstream end (front end in FIG. 1) thereof picked up by driving a pickup roller 143. The sheet P fed one by one passes along the sheet conveyance path 111 by driving the pairs of conveyor rollers 112 and is conveyed to the nip portion between the secondary transfer roller 113 and the intermediate transfer belt 124 in the image forming assembly 12.

A cleaning roller 17 for removing the toner on the intermediate transfer belt 124 is disposed at a position facing the driven roller 124*b* with the intermediate transfer belt 124 held therebetween.

Figure 2:
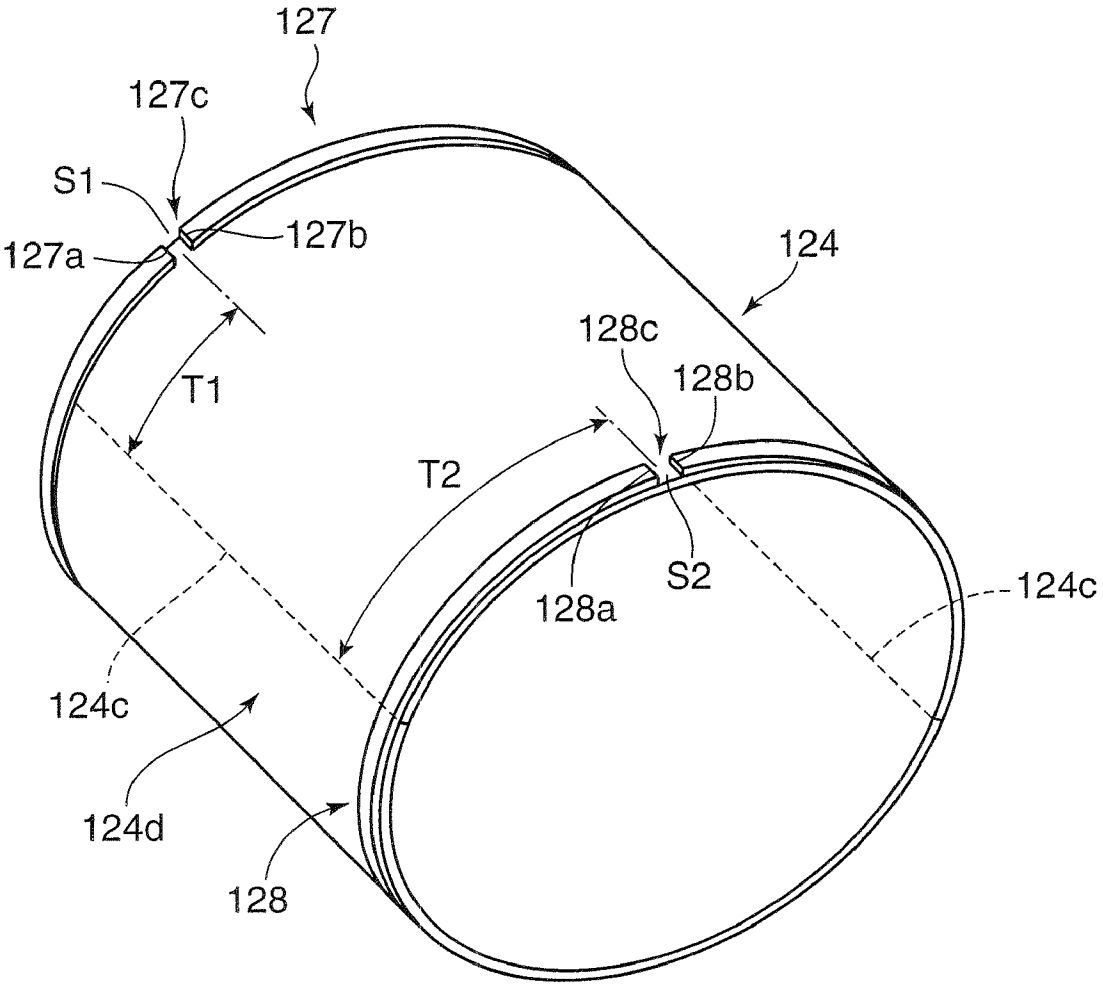
FIG. 2 is a perspective view showing an intermediate transfer belt mounted with first and second meandering prevention members.
Figure 3:
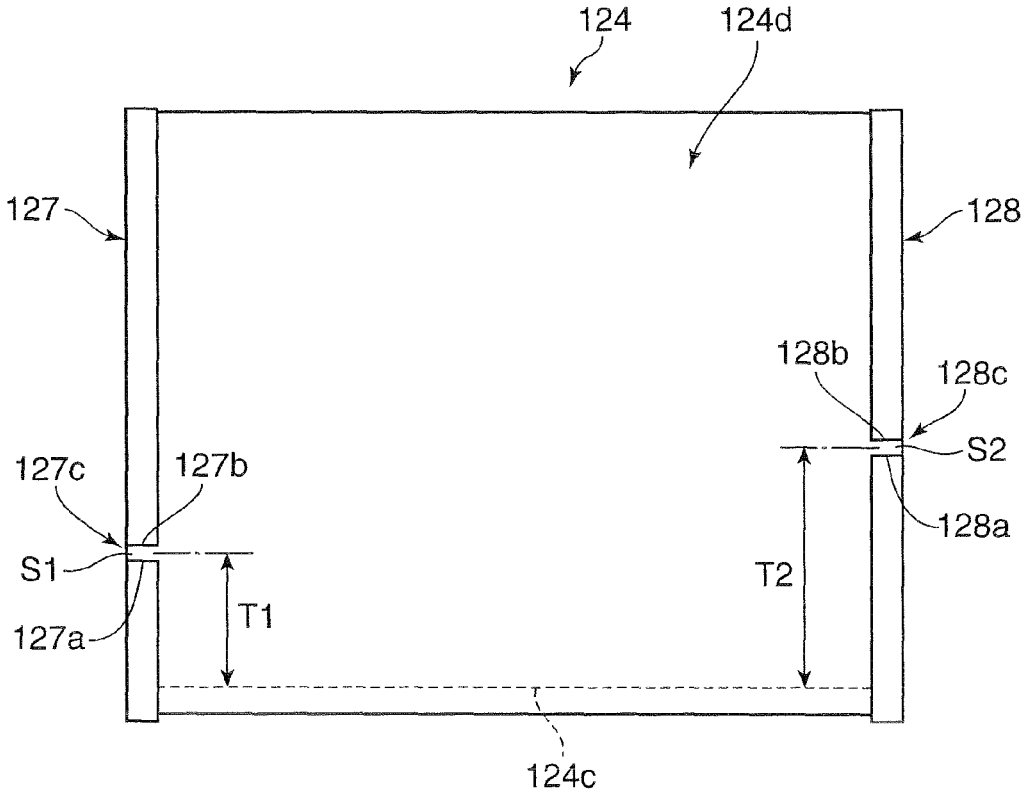
FIG. 3 is a plain view of the intermediate transfer belt shown in FIG. 2.
Figure 4:
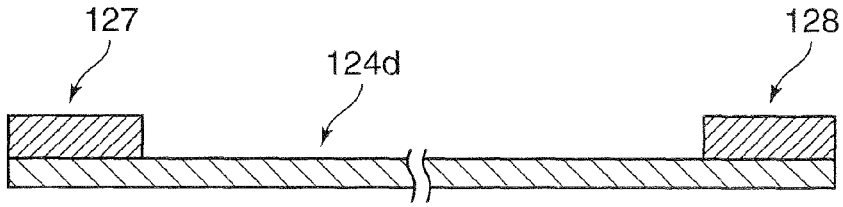
FIG. 4 is a section of the intermediate transfer belt.
Figure 5:
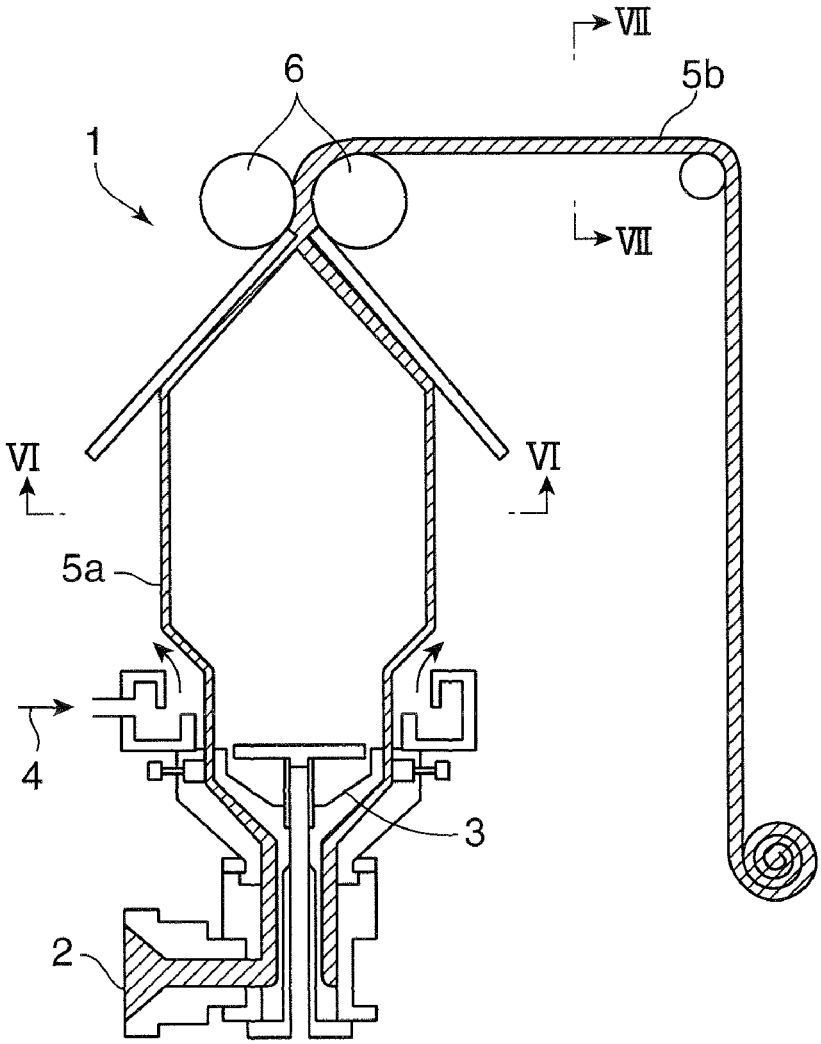
FIG. 5 is a schematic diagram of an extruder showing a method for forming an intermediate transfer belt by inflation molding using the extruder.
Figure 6:
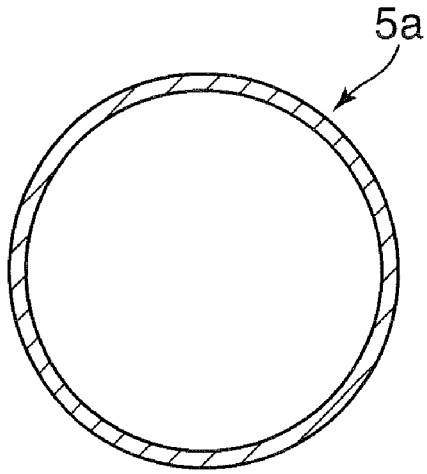
FIG. 6 is a section along VI-VI of FIG. 5.
Figure 7:
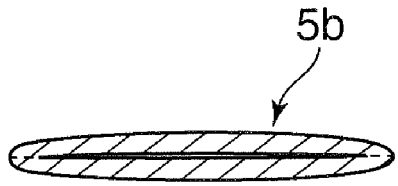
FIG. 7 is a section along VII-VII of FIG. 5.

FIGS. 2 to 4 are diagrams showing the intermediate transfer belt (belt) having first and second meandering prevention members 127, 128 mounted on a belt body 124*d*. In FIG. 2, for the sake of convenience, the intermediate transfer belt 124 is shown with the belt body 124*d* turned inside out so that the outer surface (surface where a toner image is to be transferred) of the belt body 124*d* faces inward. Next, with reference to FIGS. 2 to 4, the detailed structure of the intermediate transfer belt 124 is described.

As shown in FIG. 2, the belt body 124*d* is endless and formed by inflation molding described above. The belt body 124*d* includes a pair of folded traces (thin portions) 124*c* formed in the above inflation molding. These folded traces 124*c* extend in the width direction of the belt body 124*d*. As shown in FIG. 2, when the belt body 124*d* is seen as a cylindrical body, the pair of folded traces 124*c* are located substantially symmetrically with respect to a central axis of the cylindrical body. The belt thickness of the folded traces 124*c* is smaller than that of the other portions. It should be noted that the folds become folded traces 124*c* which is unnoticeable in appearance through a heating process or the like after the inflation molding.

As shown in FIGS. 2 to 4, the first and second meandering prevention members 127, 128 in the form of flat bars for preventing the meander occurring at the time of driving the intermediate transfer belt 124 are adhered to the opposite widthwise ends of the underside (outer circumferential surface in FIG. 2) of the belt body 124*d*. This pair of meandering prevention members 127, 128 also function to reinforce the opposite widthwise ends of the belt body 124*d*. Here, the flat bar shape means a rectangular parallelepipedic shape, wherein the longitudinal dimension (length) of the rectangular parallelepipedic shape is considerably longer than the dimensions (i.e. width and height of the rectangular parallelepipedic shape) of two sides of a plane (rectangular shape) perpendicular to the longitudinal direction. In this embodiment, the length, width and height of both meandering prevention members 127, 128 before being adhered are about 859 mm, about 5 mm and about 1 mm.

The first meandering prevention member 127 is attached to one widthwise end (left end in FIG. 3) of the belt body 124*d* such that longitudinal ends 127*a*, 127*b* abut each other while defining a clearance S1 therebetween. The opposite ends 127*a*, 127*b* of the first meandering prevention member 127 and the clearance S1 form an abutting portion 127*c*. The second meandering prevention member 128 is attached to the other widthwise end (right end in FIG. 3) of the belt body 124*d* such that longitudinal ends 128*a*, 128*b* abut each other while defining a clearance S2 therebetween. The opposite ends 128*a*, 128*b* of the second meandering prevention member 128 and the clearance S2 form an abutting portion 128*c*.

The clearance S1 is formed by setting the length of the first meandering prevention member 127 slightly shorter than the peripheral length of the belt body 124*d* beforehand lest the opposite ends 127*a*, 127*b* should overlap each other at the time of attaching the first meandering prevention member 127 to the belt body 124*d*. Similarly, the clearance S2 is formed by setting the length of the second meandering prevention member 128 slightly shorter than the peripheral length of the belt body 124*d* beforehand lest the opposite ends 128*a*, 128*b* should overlap each other at the time of attaching the second meandering prevention member 128 to the belt body 124*d*. These clearances S1, S2 are normally about 1 mm, but may be 0 (the opposite ends are in contact) in some cases. The meandering prevention members 127, 128 are made of, e.g. urethane rubber.

In this embodiment, the respective meandering prevention members 127, 128 are attached to the belt body 124*d* so that the abutting portions 127*c*, 128*c* thereof are displaced forward or backward from the two folded traces 124*c* of the belt body 124 in a rotating direction of the intermediate transfer belt 124. More specifically, the abutting portions 127*c*, 128*c* are displaced by lengths T1, T2 from the closer one 124*c* (left on in FIG. 2) of the two folded traces 124*c* of the belt body 124*d* in the rotating direction. In other words, the abutting portions 127*c*, 128*c* are arranged at positions (first and second positions) displaced by the lengths T1, T2 from the folded trace 124*c* in the rotating direction of the intermediate transfer belt 124.

Both of the above displaced lengths T1, T2 are preferably equal to or longer than about 50 mm. If the displaced lengths T1, T2 are shorter than about 50 mm, it becomes difficult to prevent cracks at the folded traces 124*c* in some cases. The entire length and the entire width of the belt body 124*d* of this embodiment are about 860 mm and about 300 mm. The thickness except at the folded traces of the belt body 124*d* of this embodiment is about 0.2 mm.

In this embodiment, as shown in FIG. 3, the pair of meandering prevention members 127, 128 are attached to the belt body 124*d* so that the abutting portions 127*c*, 128*c* thereof are displaced forward or backward from each other in the rotating direction of the intermediate transfer belt 124.

As described above, in the belt body 124*d* formed by inflation molding, the folded traces 124*c* are thinner than the other parts of the belt body 124*d* and, accordingly, have lower strength. Thus, upon driving the intermediate transfer belt 124 mounted between the rollers, cracks are likely to occur at the opposite ends of the folded traces 124*c* due to various loads such as tensile stresses and bending stresses acting on the intermediate transfer belt 124. Accordingly, in this embodiment, the respective abutting portions 127*c*, 128*c* of the pair of meandering prevention members 127, 128 for preventing the meander of the intermediate transfer belt 124 are intentionally displaced forward or backward from the folded traces 124*c* in the rotating direction of the intermediate transfer belt 124 to actively cover the opposite ends of the folded traces 124*c* by the respective meandering prevention members 127, 128, whereby the opposite ends of the folded traces 124*c* having relatively lower strength in the belt body 124*d* are reliably reinforced by the meandering prevention members 127, 128. As a result, the occurrence of cracks starting from one of the opposite ends of the folded traces 124*c* of the belt body 124*d* can be suppressed. Since the existing meandering prevention members 127, 128 are effectively utilized in the intermediate transfer belt 124 of this embodiment, the durability of the intermediate transfer belt 124 can be improved without increasing the number of parts.

Since the respective abutting portions 127*c*, 128*c* and the folded traces 124*c* are intentionally displaced in the rotating direction of the intermediate transfer belt 124 in this embodiment as described above, vibration resulting from the turning movement of the intermediate transfer belt 124 can be prevented from becoming excessive. Specifically, fine vibration occurs due to the unevenness of the abutting portions 127*c*, 128*c* and the folded traces 124*c* when the abutting portions 127*c*, 128*c* and the folded traces 124*c* pass the positions (primary transfer positions) of the photoconductive drums 120 and the primary transfer rollers 125 disposed at facing positions with the intermediate transfer belt 124 located therebetween. Thus, if the abutting portions 127*c*, 128*c* and the folded traces 124*c* are displaced in the rotating direction of the intermediate transfer belt 124, they pass the above primary transfer positions at different timings. Therefore, the occurring timings of the vibration when the folded traces 124*c* pass the primary transfer positions and those of the vibration when the abutting portions 127*c*, 128*c* pass the primary transfer positions can be shifted. This can prevent the vibration from becoming excessive by being amplified as described above, wherefore the transferred image on the sheet P is unlikely to be disturbed.

Specifically, since the abutting portions 127*c*, 128*c* of the pair of meandering prevention members 127, 128 are displaced from each other in the rotating direction of the intermediate transfer belt 124 in this embodiment, vibration occurring timings when the respective abutting portions 127*c*, 128*c* pass the primary transfer positions can be shifted. Since this can suppress the amplification of the vibrations by the two abutting portions 127*c*, 128*c*, the disturbance of the transferred image caused by the vibration can be further suppressed.

The present invention is not limited to the above embodiment and also embraces the following contents.

Although the printer 10 is taken as an example of the image forming apparatus according to the present invention in the above embodiment, the present invention is not limited thereto and is also applicable to copiers, facsimile machines and the like. The present invention is applicable not only to color printers, but also to monochromatic printers.

Although the intermediate transfer belt 124 is taken as an example of the endless belt according to the present invention in the above embodiment, the present invention is not limited thereto and is also applicable to transfer belts of the direct transfer type and conveyor belts driven by rollers.

Although the intermediate transfer belt 124 including the first and second meandering prevention members 127, 128 is taken as an example of the endless belt according to the present invention in the above embodiment, the present invention is not limited thereto. The endless belt according to the present invention may include only one meandering prevention member or three or more meandering prevention members.

Although the intermediate transfer belt 124, in which the displaced length T1 is shorter than the displaced length T2, is taken as an example of the endless belt according to the present invention in the above embodiment, the present invention is not limited thereto. The endless belt according to the present invention may be such an endless belt that the displaced length T1 is longer than the displaced length T2 or such an endless belt that the displaced lengths T1, T2 are equal.

The specific embodiment described above mainly embraces inventions having the following constructions.

An endless belt according to one aspect of the present invention comprises: an endless belt body; and a first meandering prevention member which is a member in the form of a flat bar and adapted to prevent meandering of the belt body, wherein: the belt body includes a folded trace extending in the width direction thereof; the first meandering prevention member is attached on one widthwise end of a circumferential surface of the belt body such that one widthwise end of the folded trace is covered thereby and the opposite longitudinal ends of the first meandering prevention member abut each other in a rotating direction of the belt body; and an abutting portion at the opposite ends of the first meandering prevention member is arranged at a position displaced from the folded trace by a specified distance in the rotating direction of the belt body.

In the above construction, the belt body may be formed by inflation molding and the folded trace may be formed in forming the belt by the inflation molding. In the above construction, the folded trace may be a thin portion whose thickness is thinner than other portions.

According to these constructions, the abutting portion at the opposite ends of the first meandering prevention member is intentionally arranged at the position displaced by the specified distance from the folded trace in the rotating direction of the belt and the first meandering prevention member covers the one widthwise end of the folded trace. Thus, one end of the folded trace having relatively low strength in the belt body can be reliably reinforced by the first meandering prevention member. If the folded trace is the thin portion, the occurrence of a crack from the thin portion can be suppressed by the first meandering prevention member. Therefore, the above belt has better durability than conventional belts.

Further, since the abutting portion at the opposite ends of the first meandering prevention member is intentionally arranged at the position displaced by the specified distance from the folded trace in the rotating direction of the belt according to these constructions, vibration resulting from a turning movement of the belt can be prevented from becoming excessive if the belt is mounted in a belt conveyor or an image forming apparatus. Therefore, the occurrence of various inconveniences resulting from the vibration of the belt can be prevented.

In these constructions, it is preferable that the endless belt further comprises a second meandering prevention member which is a member in the form of a flat bar and adapted to prevent the meander of the belt body; that the second meandering prevention member is attached on the other widthwise end of the circumferential surface of the belt body such that the other widthwise end of the folded trace is covered thereby and the opposite longitudinal ends of the second meandering prevention member abut each other in the rotating direction of the belt body; and that an abutting portion at the opposite ends of the second meandering prevention member is arranged at a position displaced from the folded trace by a specified distance in the rotating direction of the belt body.

According to this construction, not only the abutting portion at the opposite ends of the first meandering prevention member, but also the abutting portion at the opposite ends of the second meandering prevention member is intentionally displaced by the specified distance from the folded trace in the rotating direction of the belt, the first meandering prevention member covers the one widthwise end of the folded trace and the second meandering prevention member covers the other widthwise end of the folded trace. Thus, not only the one end of the folded trace can be reliably reinforced by the first meandering prevention member, but also the other end thereof can be reliably reinforced by the second meandering prevention member. In other words, the opposite ends of the folded trace of the belt body can be reliably reinforced by the both meandering prevention members. As a result, the occurrence of cracks at the opposite ends of the folded trace can be suppressed. Therefore, the belt comprising the first and second meandering prevention members has even better durability as compared with the belt comprising only the first meandering prevention member.

In this construction, it is preferable that the abutting portion at the opposite ends of the first meandering prevention member is arranged at a first position in the rotating direction of the belt; and that the abutting portion at the opposite ends of the second meandering prevention member is arranged at a second position displaced by a specified distance from the first position in the rotating direction of the belt.

According to this construction, since the second position is displaced by the specified distance from the first position in the rotating direction of the belt, vibration occurring timings when the respective abutting portions pass, for example, a roller disposed position and a primary transfer position can be shifted in the case where the belt is mounted in a belt conveyor or an image forming apparatus. Since the amplification of the vibration caused by the two abutting portions can be suppressed in this way, the occurrence of various inconveniences resulting from the vibration of the belt can be further prevented.

A belt conveyor according to another aspect of the present invention comprises: a first roller; a second roller; and an endless belt mounted on the first and second rollers, wherein: the endless belt includes an endless belt body and a first meandering prevention member; the belt body includes a folded trace extending in the width direction thereof; the first meandering prevention member is a member in the form of a flat bar, adapted to prevent the meandering of the belt body and attached on one widthwise end of a circumferential surface of the belt body such that one widthwise end of the folded trace is covered thereby and the opposite longitudinal ends of the first meandering prevention member abut each other in a rotating direction of the belt body; and an abutting portion at the opposite ends of the first meandering prevention member is arranged at a position displaced from the folded trace by a specified distance in the rotating direction of the belt body.

In the above construction, the belt body may be formed by inflation molding and the folded trace may be formed in forming the belt by the inflation molding. In the above construction, the folded trace may be a thin portion whose thickness is thinner than other portions.

According to these constructions, the abutting portion at the opposite ends of the first meandering prevention member is intentionally arranged at the position displaced by the specified distance from the folded trace in the rotating direction of the belt and the first meandering prevention member covers the one widthwise end of the folded trace. Thus, one end of the folded trace having relatively low strength in the belt body can be reliably reinforced by the first meandering prevention member. If the folded trace is the thin portion, the occurrence of a crack from the thin portion can be suppressed by the first meandering prevention member. Since this belt conveyor effectively utilizes the existing meandering prevention member, better durability can be obtained without increasing the number of parts as compared with a belt conveyor including a conventional belt.

Further, since the abutting portion at the opposite ends of the first meandering prevention member is intentionally arranged at the position displaced by the specified distance from the folded trace in the rotating direction of the belt according to these constructions, vibration resulting from a turning movement of the belt can be prevented from becoming excessive. Specifically, fine vibration resulting from the unevenness of the abutting portion and the folded trace occurs when the abutting portion and the folded trace pass the disposed position of the first roller or second roller for supporting and driving the belt. Thus, if the abutting portion and the folded trace are displaced in the rotating direction of the belt, they pass the above roller disposed position at different timings. Thus, the occurring timing of the vibration when the folded trace passes the roller disposed position and that of the vibration when the abutting portion passes the roller disposed position can be shifted. Therefore, as described above, the vibration occurring in the belt conveyor can be prevented from becoming excessive by being amplified.

In these constructions, it is preferable that the endless belt further comprises a second meandering prevention member which is a member in the form of a flat bar and adapted to prevent the meander of the belt body; that the second meandering prevention member is attached on the other widthwise end of the circumferential surface of the belt body such that the other widthwise end of the folded trace is covered thereby and the opposite longitudinal ends of the second meandering prevention member abut each other in the rotating direction of the belt body; and that an abutting portion at the opposite ends of the second meandering prevention member is arranged at a position displaced from the folded trace by a specified distance in the rotating direction of the belt body.

According to this construction, not only the abutting portion at the opposite ends of the first meandering prevention member, but also the abutting portion at the opposite ends of the second meandering prevention member is intentionally displaced by the specified distance from the folded trace in the rotating direction of the belt, the first meandering prevention member covers the one widthwise end of the folded trace and the second meandering prevention member covers the other widthwise end of the folded trace. Thus, not only the one end of the folded trace can be reliably reinforced by the first meandering prevention member, but also the other end thereof can be reliably reinforced by the second meandering prevention member. In other words, the opposite ends of the folded trace of the belt body can be reliably reinforced by the both meandering prevention members. Since the belt including the first and second meandering prevention members has better durability than the belt including only the first meandering prevention member, the belt conveyor comprising the belt including the first and second meandering prevention members has even better durability than the belt conveyor comprising the belt including only the first meandering prevention member.

According to this construction, not only the first meandering prevention member is attached on the one widthwise end of the circumferential surface of the belt body, but also the second meandering prevention member is attached on the other widthwise end. Thus, this belt conveyor can more reliably prevent the meander of the belt as compared with the case where the belt including only the first meandering prevention member is mounted.

In this construction, it is preferable that the abutting portion at the opposite ends of the first meandering prevention member is arranged at a first position in the rotating direction of the belt; and that the abutting portion at the opposite ends of the second meandering prevention member is arranged at a second position displaced by a specified distance from the first position in the rotating direction of the belt.

According to this construction, since the second position is displaced by the specified distance from the first position in the rotating direction of the belt, vibration occurring timings when the respective abutting portions pass, for example, roller disposed positions can be shifted. Since the amplification of the vibrations caused by the two abutting portions can be suppressed in this way, the vibration of the belt conveyor can be further suppressed.

An image forming apparatus according to still another aspect of the present invention comprises: a photoconductive drum capable of bearing a toner image; an endless intermediate transfer belt held in contact with the photoconductive drum and mounted on a plurality of rollers; a primary transfer roller for transferring a toner image formed on the photoconductive drum to the intermediate transfer belt; and a secondary transfer roller for transferring the toner image on the intermediate transfer belt to a sheet, wherein: the intermediate transfer belt includes an endless belt body and a first meandering prevention member; the belt body includes a folded trace extending in the width direction thereof; the first meandering prevention member is a member in the form of a flat bar, adapted to prevent the meander of the belt body and attached on one widthwise end of a circumferential surface of the belt body such that one widthwise end of the folded trace is covered thereby and the opposite longitudinal ends of the first meandering prevention member abut each other in a rotating direction of the belt body; and an abutting portion at the opposite ends of the first meandering prevention member is arranged at a position displaced from the folded trace by a specified distance in the rotating direction of the belt body.

In the above construction, the belt body may be formed by inflation molding and the folded trace may be formed in forming the belt by the inflation molding. In the above construction, the folded trace may be a thin portion whose thickness is thinner than other portions.

According to these constructions, the abutting portion at the opposite ends of the first meandering prevention member is intentionally arranged at the position displaced by the specified distance from the folded trace in the rotating direction of the belt and the first meandering prevention member covers the one widthwise end of the folded trace. Thus, one end of the folded trace having relatively low strength in the belt body can be reliably reinforced by the first meandering prevention member. If the folded trace is the thin portion, the occurrence of a crack from the thin portion can be suppressed by the first meandering prevention member. Since this image forming apparatus effectively utilizes the existing meandering prevention member, better durability can be obtained without increasing the number of parts as compared with an image forming apparatus including a conventional belt.

Further, since the abutting portion at the opposite ends of the first meandering prevention member is intentionally arranged at the position displaced by the specified distance from the folded trace in the rotating direction of the belt according to these constructions, vibration resulting from a turning movement of the intermediate transfer belt can be prevented from becoming excessive. Specifically, fine vibration resulting from the unevenness of the abutting portion and the folded trace occurs when the abutting portion and the folded trace pass, for example, the disposed position (primary transfer position) of the photoconductive drum and the primary transfer roller facing each other with the intermediate transfer belt held therebetween. Thus, if the abutting portion and the folded trace are displaced in the rotating direction of the belt, they pass the primary transfer position at different timings. Thus, the occurring timing of the vibration when the folded trace passes the primary transfer position and that of the vibration when the abutting portion passes the primary transfer position can be shifted. Therefore, as described above, the vibration can be prevented from becoming excessive by being amplified and, hence, a transferred image on the sheet is unlikely to be disturbed.

In these constructions, it is preferable that the endless belt further comprises a second meandering prevention member which is a member in the form of a flat bar and adapted to prevent the meander of the belt body; that the second meandering prevention member is attached on the other widthwise end of the circumferential surface of the belt body such that the other widthwise end of the folded trace is covered thereby and the opposite longitudinal ends of the second meandering prevention member abut each other in the rotating direction of the belt body; and that an abutting portion at the opposite ends of the second meandering prevention member is arranged at a position displaced from the folded trace by a specified distance in the rotating direction of the belt body.

According to this construction, not only the abutting portion at the opposite ends of the first meandering prevention member, but also the abutting portion at the opposite ends of the second meandering prevention member is intentionally displaced by the specified distance from the folded trace in the rotating direction of the belt, the first meandering prevention member covers the one widthwise end of the folded trace and the second meandering prevention member covers the other widthwise end of the folded trace. Thus, not only the one end of the folded trace can be reliably reinforced by the first meandering prevention member, but also the other end thereof can be reliably reinforced by the second meandering prevention member. In other words, the opposite ends of the folded trace of the belt body can be reliably reinforced by the both meandering prevention members. Since the belt including the first and second meandering prevention members has better durability than the belt including only the first meandering prevention member, the image forming apparatus comprising the belt including the first and second meandering prevention members has even better durability than the image forming apparatus comprising the belt including only the first meandering prevention member.

According to this construction, not only the first meandering prevention member is attached on the one widthwise end of the circumferential surface of the belt body, but also the second meandering prevention member is attached on the other widthwise end. Thus, this image forming apparatus can more reliably prevent the meander of the belt as compared with the case where the belt including only the first meandering prevention member is mounted.

In this construction, it is preferable that the abutting portion at the opposite ends of the first meandering prevention member is arranged at a first position in the rotating direction of the belt; and that the abutting portion at the opposite ends of the second meandering prevention member is arranged at a second position displaced by a specified distance from the first position in the rotating direction of the belt.

According to this construction, since the second position is displaced by the specified distance from the first position in the rotating direction of the belt, vibration occurring timings when the respective abutting portions pass, for example, the above primary transfer position can be shifted. Since the amplification of the vibrations caused by the two abutting portions can be suppressed in this way, the disturbance of a transferred image caused by the vibration can be further suppressed.

This application is based on patent application No. 2007-154198 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An endless belt, comprising:

an endless belt body having opposite first and second widthwise ends spaced apart in a width direction; and first and second meandering prevention members in the form of a flat bars and adapted to prevent meandering of the belt body, wherein:

the belt body includes a folded trace extending in the width direction of the belt body;

the first meandering prevention member is attached on the first widthwise end of a circumferential surface of the belt body such that a first widthwise end of the folded trace is covered by the first meandering prevention member and opposite longitudinal ends of the first meandering prevention member substantially abut each other in a rotating direction of the belt body;

a first abutting portion at the opposite ends of the first meandering prevention member is arranged at a position displaced from the folded trace by a specified distance in the rotating direction of the belt body;

the second meandering prevention member is attached on the second widthwise end of the circumferential surface of the belt body such that a second widthwise end of the folded trace is covered by the second meandering prevention member and opposite longitudinal ends of the second meandering prevention substantially abut each other in the rotating direction of the belt body; and a second abutting portion at the opposite ends of the second meandering prevention member is arranged at a position displaced from the folded trace by a specified distance in the rotating direction of the belt body.

2. An endless belt according to claim 1, wherein:

the belt body is formed by inflation molding; and the folded trace is formed in forming the belt by the inflation molding.

3. An endless belt according to claim 1, wherein the folded trace is a thin portion whose thickness is thinner than other portions.

4. An endless belt according to claim 1, wherein:

the abutting portion of the first meandering prevention member is arranged at a first position in the rotating direction of the belt; and the abutting portion of the second meandering prevention member is arranged at a second position displaced by a specified distance from the first position in the rotating direction of the belt.

5. A belt conveyor, comprising:

a first roller;

a second roller; and an endless belt mounted on the first and second rollers, wherein:

the endless belt includes an endless belt body having opposite first and second widthwise ends spaced apart in a widthwise direction and first and second meandering prevention members in the form of flat bars adapted to prevent meandering of the belt body;

the belt body includes a folded trace extending in the width direction of the belt body;

the first meandering prevention member is attached on the first widthwise end of a circumferential surface of the belt body such that a first widthwise end of the folded trace is covered by the first meandering prevention member and opposite longitudinal ends of the first meandering prevention member substantially abut each other in a rotating direction of the belt body;

a first abutting portion at the opposite ends of the first meandering prevention member is arranged at a position displaced from the folded trace by a specified distance in the rotating direction of the belt body;

the second meandering prevention member is attached on the second widthwise end of the circumferential surface of the belt body such that a second widthwise end of the folded trace is covered by the second meandering prevention member and the opposite longitudinal ends of the second meandering prevention member substantially abut each other in the rotating direction of the belt body; and a second abutting portion at the opposite ends of the second meandering prevention member is arranged at a position displaced from the folded trace by a specified distance in the rotating direction of the belt body.

6. A belt conveyor according to claim 5, wherein:

the belt body is formed by inflation molding; and the folded trace is formed in forming the belt by the inflation molding.

7. A belt conveyor according to claim 5, wherein the folded trace is a thin portion whose thickness is thinner than other portions.

8. A belt conveyor according to claim 5, wherein:

the abutting portion of the first meandering prevention member is arranged at a first position in the rotating direction of the belt; and the abutting portion of the second meandering prevention member is arranged at a second position displaced by a specified distance from the first position in the rotating direction of the belt.

9. An image forming apparatus, comprising:

a photoconductive drum capable of bearing a toner image;

an endless intermediate transfer belt held in contact with the photoconductive drum and mounted on a plurality of rollers;

a primary transfer roller for transferring a toner image formed on the photoconductive drum to the intermediate transfer belt; and a secondary transfer roller for transferring the toner image on the intermediate transfer belt to a sheet, wherein:

the intermediate transfer belt includes an endless belt body having opposite first and second widthwise ends spaced apart in a width direction and first and second meandering prevention members in the form of flat bars adapted to prevent meander of the belt body;

the belt body includes a folded trace extending in the width direction of the belt body;

the first meandering prevention member is attached on the first widthwise end of a circumferential surface of the belt body such that a first widthwise end of the folded trace is covered by the first meandering prevention member and opposite longitudinal ends of the first meandering prevention member substantially abut each other in a rotating direction of the belt body;

a first abutting portion at the opposite ends of the first meandering prevention member is arranged at a position displaced from the folded trace by a specified distance in the rotating direction of the belt body;

the second meandering prevention member is attached on the second widthwise end of the circumferential surface of the belt body such that a second widthwise end of the folded trace is covered by the second meandering prevention member and the opposite longitudinal ends of the second meandering prevention member substantially abut each other in the rotating direction of the belt body; and an abutting portion at the opposite ends of the second meandering prevention member is arranged at a position displaced from the folded trace by a specified distance in the rotating direction of the belt body.

10. An image forming apparatus according to claim 9, wherein:

the belt body is formed by inflation molding; and the folded trace is formed in forming the belt by the inflation molding.

11. An image forming apparatus according to claim 9, wherein the folded trace is a thin portion whose thickness is thinner than other portions.

12. An image forming apparatus according to claim 9, wherein:

the abutting portion of the first meandering prevention member is arranged at a first position in the rotating direction of the belt; and the abutting portion of the second meandering prevention member is arranged at a second position displaced by a specified distance from the first position in the rotating direction of the belt.

* * * * *